US010894438B2

(12) United States Patent
Muraoka

(10) Patent No.: US 10,894,438 B2
(45) Date of Patent: Jan. 19, 2021

(54) PRINTING BLANKET AND PRINTING METHOD

(71) Applicant: SHUHOU CO., LTD., Fukui (JP)

(72) Inventor: Kouji Muraoka, Fukui (JP)

(73) Assignee: SHUHOU CO., LTD, Fukui (JP)

( * ) Notice: Subject to any disclaimer, the term of this patent is extended or adjusted under 35 U.S.C. 154(b) by 347 days.

(21) Appl. No.: 15/735,435

(22) PCT Filed: Aug. 1, 2016

(86) PCT No.: PCT/JP2016/072472
§ 371 (c)(1),
(2) Date: Dec. 11, 2017

(87) PCT Pub. No.: WO2018/025299
PCT Pub. Date: Feb. 8, 2018

(65) Prior Publication Data

US 2020/0039276 A1 Feb. 6, 2020

(51) Int. Cl.
*B41N 10/04* (2006.01)
*B41F 17/00* (2006.01)
(Continued)

(52) U.S. Cl.
CPC ..... *B41N 10/04* (2013.01); *B41F 17/001* (2013.01); *B41N 10/00* (2013.01); *B41N 10/02* (2013.01); *B41N 2210/06* (2013.01)

(58) Field of Classification Search
CPC ..... B41F 17/001; B41F 17/006; B41F 17/08; B41F 17/28; B41M 1/26; B41M 1/28;
(Continued)

(56) References Cited

U.S. PATENT DOCUMENTS 5,066,537 A * 11/1991 O'Rell ..... B41N 10/02 428/909
7,870,823 B1 1/2011 Cameron
(Continued)

FOREIGN PATENT DOCUMENTS

CN 102781679 A 11/2012
CN 105751724 A 7/2016
(Continued)

OTHER PUBLICATIONS

International Search Report (ISR) and Written Opinion (WO) dated Oct. 4, 2016 for International Application No. PCT/JP2016/072742.
(Continued)

*Primary Examiner* — Matthew G Marini
*Assistant Examiner* — Marissa Ferguson-Samreth
(74) *Attorney, Agent, or Firm* — Ladas & Parry LLP

(57) ABSTRACT

Provided are a printing blanket and a printing method that enable printing on a printing member having a curved surface at an edge. The printing blanket includes a base member made of an elastic material having a three-dimensional shape with a recessed portion or a hole portion in a center of the base member and a ridge line surrounding the recessed portion or the hole portion, and a printing surface arranged on a surface of the base member on an outer side from the ridge line.

8 Claims, 2 Drawing Sheets

(51) Int. Cl.
*B41N 10/00* (2006.01)
*B41N 10/02* (2006.01)

(58) Field of Classification Search
CPC ..... B41M 1/40; B41N 10/00; B41N 10/02; B41N 10/005; B41N 10/04
See application file for complete search history.

(56) References Cited

U.S. PATENT DOCUMENTS

| | | | | |
|---|---|---|---|---|
| 2002/0006472 | A1* | 1/2002 | Kazi | B05D 1/28 427/388.1 |
| 2008/0011177 | A1* | 1/2008 | Muraoka | B41M 1/02 101/492 |
| 2009/0211476 | A1* | 8/2009 | Inoue | A63B 45/02 101/401 |
| 2010/0040851 | A1 | 2/2010 | Schroeder | |
| 2011/0315035 | A1 | 12/2011 | Muraoka | |
| 2012/0318154 | A1 | 12/2012 | Muraoka | |
| 2013/0008330 | A1 | 1/2013 | Yoo et al. | |
| 2013/0042772 | A1 | 2/2013 | Muraoka | |

FOREIGN PATENT DOCUMENTS

| | | | |
|---|---|---|---|
| EP | 2 543 519 | A1 | 1/2013 |
| EP | 2 561 988 | A1 | 2/2013 |
| JP | 62-132691 | A | 6/1987 |
| JP | 04263995 | A | 9/1992 |
| JP | 2011-183604 | A | 9/2011 |
| JP | 2011-224892 | A | 11/2011 |
| JP | 2016-189549 | A | 11/2016 |
| KR | 10-0854208 | | 8/2008 |
| KR | 10-2011-0105733 | | 9/2011 |
| KR | 10-2011-0126150 | A | 11/2011 |
| KR | 10-1513868 | | 4/2015 |

OTHER PUBLICATIONS espacenet English abstract of JP 2011-224892 A.
espacenet English abstract of JP 2011-183604 A.
espacenet English abstract of JP 62-132691 A.
espacenet English abstract of JP 2016-189549 A which corresponds to Japanese Unexamined Patent Application Publication No. 2016-68909.
Chinese Office Action with an English translation dated Aug. 19, 2019 for Application No. CN 20168003350.9.
Korean Office Action with an English translation dated Sep. 25, 2019 for Application No. KR 10-2017-7034971.
Chinese Office Action with English translation dated Jan. 25, 2019 for Application No. CN 201680035350.9.
Korean Office Action with English translation dated Mar. 12, 2019 for Application No. KR 10-2017-7034971.
espacenet English abstract of CN 105751724 A.
English translation of CN 105751724 A.
espacenet English abstract of CN 102781679 A.
English translation of CN 102781679 A.
English translation of KR 10-1513868.
English translation of KR 10-0854208.
English translation of KR 10-2011-0105733.
Korean Office Action with an English translation dated Aug. 1, 2019 for Application No. KR 10-2017-7034971.
Supplementary European Search Report dated Mar. 10, 2020 for Application No. EP 16901910.6.
Korean Office Action with an English translation dated Apr. 23, 2020 for Application No. KR 10-2019-7031719.
Korean Office Action with an English translation dated Jun. 9, 2020 for Application No. KR 10-2019-7031719.
Japanese Office Action with an English translation dated Jun. 23, 2020 for Application No. JP 2018-505044.
Korean Office Action with an English translation dated Nov. 18, 2019 for Application No. KR 10-2019-7031719.

* cited by examiner

PRINTING BLANKET AND PRINTING METHOD

RELATED APPLICATION

This application is an application under 35 U.S.C. 371 of International Application No. PCT/JP2016/072472 filed on Aug. 1, 2016, the entire contents of which are incorporated herein by reference.

TECHNICAL FIELD

The present invention relates to a printing blanket used for blanket printing involving transfer of an ink from a printing original plate to the printing blanket and then from the printing blanket to a surface to be printed, and to a printing method using the printing blanket.

BACKGROUND ART

Blanket printing has been performed in the following manner. A printing surface of a printing blanket is pressed against a printing original plate so that an ink arranged on the printing original plate corresponding to a printing pattern is transferred to the printing blanket. Subsequently, the printing surface of the printing blanket having the transferred ink is pressed against a surface to be printed so that the transferred ink on the printing blanket is transferred to the surface to be printed. In this manner, the printing pattern is printed on the surface to be printed.

A cover member for a display portion of, for example, a touch panel in electronic devices such as a smartphone is manufactured through use of, for example, a flat glass sheet. The cover member includes a shielding layer on a surface along an edge of the flat glass sheet to cover, for example, wires in a portion other than the display portion.

In the related art, the shielding layer is arranged on a flat surface, for example, by being formed through screen printing or by bonding a thin film (see, for example, Patent Literature 1)

CITATION LIST

Patent Literature

Patent Literature 1: Japanese Unexamined Patent Application Publication No. 2015-68909

SUMMARY OF INVENTION

Technical Problem

In recent years, as the cover for a display member of a touch panel in electronic devices such as a smartphone, a member having a curved surface and being made of a material such as glass and polycarbonate is adopted in many cases to make a screen look wider. The cover for a display member has been a flat plate, and hence the shielding layer can be printed on the cover by screen printing. However, when the cover for a display member is manufactured through use of a member having a curved surface, to arrange the shielding layer, the cover is manufactured by the steps of masking a portion other than a portion for arranging the shielding layer, coating the portion for arranging the shielding layer, cutting off a part of the coated portion by laser processing, and finishing. Thus, the steps are complicated and cause a high rate of defects, resulting in high manufacturing cost.

The present invention has been made to solve the above-mentioned problems, and an object of the present invention is to provide a printing blanket and a printing method that enable high-quality printing on a printing member, for example, a cover member for a touch panel having a curved surface and enable reduction in cost for arranging a shielding layer.

Solution to Problem

According to one embodiment of the present invention, there is provided a printing blanket including a base member formed of an elastic material having a three-dimensional shape with a recessed portion or a hole portion in a center of the base member and a ridge line surrounding the recessed portion or the hole portion, and a printing surface arranged on a surface of the base member on an outer side from the ridge line.

Further, a printing method according to one embodiment of the present invention is a printing method using the above-mentioned printing blanket. The printing method includes an original plate pressing step of pressing the printing surface against a printing original plate having an ink arranged on the printing original plate, and an ink transferring step of transferring the ink to a curved surface portion of a printing member having a flat surface and a curved surface in an edge portion of the flat surface by pressing the printing surface against the curved surface portion.

Advantageous Effects of Invention

With the printing blanket and the printing method using the printing blanket according to one embodiment of the present invention, a force at which the printing blanket is pressed is concentrated to a curved surface corresponding to a printing portion and applied uniformly over the entire printing portion. Consequently, a printed layer has a uniform thickness, and printing can be performed without unevenness. Further, the method involves a simple step of merely pressing the printing blanket. Consequently, the quality of printing as the shielding layer of the cover member for a display portion, for example, a touch panel having a curved surface can be ensured, and cost for printing can be reduced.

DESCRIPTION OF EMBODIMENTS

Embodiment 1

Figure 1:
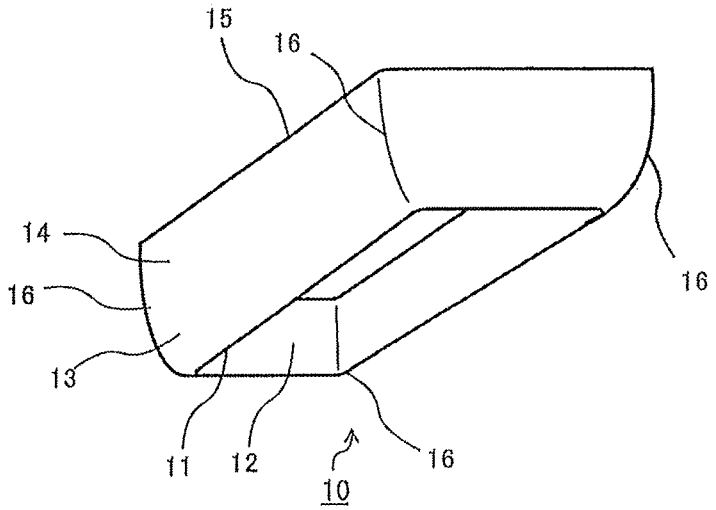
FIG. 1 is a perspective view of a printing blanket according to Embodiment 1 of the present invention.

A printing blanket according to the present invention is described below with reference to the drawings. The present invention is not limited to an embodiment described below. In the drawings, the same parts are denoted by the same reference signs, and the description of the same parts is partially omitted herein. Each drawing is a schematic illustration, and the present invention is not limited to the illustrated forms. In particular, the thickness of the sheet is exaggerated. The term "elastic body" or "elastic" as used herein is not limited to a member exhibiting a linear relationship between a load applied to the member and the amount of deformation caused by the load, but includes a member exhibiting a non-linear relationship and is restored to an original state promptly or after a predetermined time period when the applied load is released.

Figure 2:
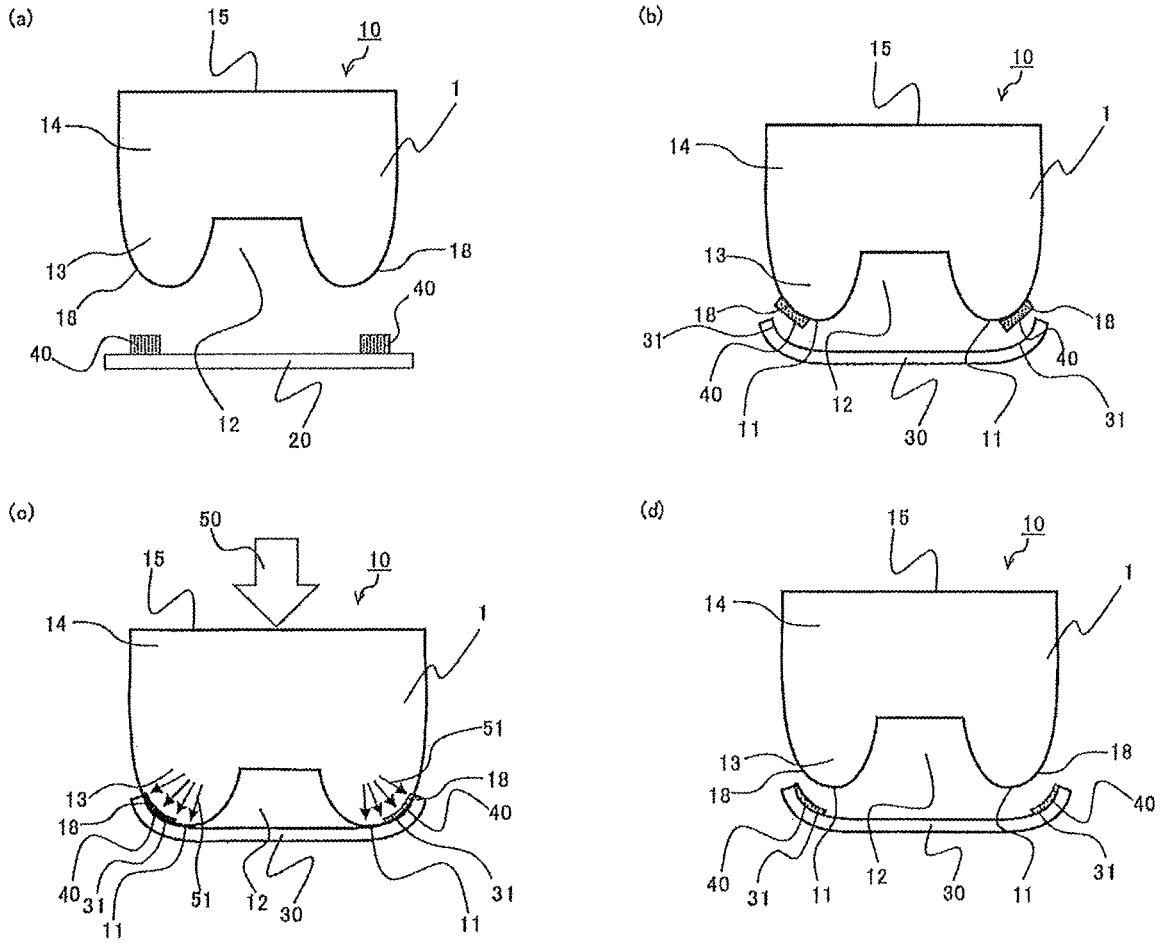
FIG. 2 are explanatory views for illustrating printing with the printing blanket according to Embodiment 1 of the present invention.

FIG. 1 is a perspective view of a printing blanket 10 according to Embodiment 1 of the present invention. FIG. 2 are explanatory views for illustrating printing with the printing blanket 10 according to Embodiment 1 of the present invention. The printing blanket 10 illustrated in FIG. 1 is an elastic body having a recessed portion 12 in a center. A ridge line 11 surrounding the periphery of the recessed portion 12 is a site that is first brought into contact with a printing original plate 20 and a printing member 30 being a target for printing when the printing blanket 10 is pressed against the printing original plate 20 and the printing member 30. As illustrated in FIG. 2, the printing blanket 10 is pressed against the printing original plate 20 having an ink 40 arranged on the printing original plate 20 and transfers the ink 40 to a printing surface 18 on a surface of the elastic body. The printing surface 18 is pressed against the printing member 30 in this state to transfer the ink 40 to the printing member 30. In this manner, printing is performed. A base member 1 is mounted to, for example, a vertically-movable portion that is arranged in a printing device (not shown) and moves vertically. A mounting surface 15 of the base member 1 is mounted to the vertically-movable portion, and the base member 1 moves vertically in the printing device. The printing surface 18 is repeatedly pressed against the printing original plate 20 and the printing member 30. In this manner, printing on the printing member 30 is performed.

The printing blanket 10 includes the base member 1 having a substantially rectangular shape when the printing blanket 10 is viewed in a direction from a side on which the printing original plate 20 and the printing member 30 are arranged on the printing device, that is, in a direction from a lower side in FIG. 2. The base member 1 has the recessed portion 12 in the center. The recessed portion 12 is formed to be surrounded by a protruding portion 13 formed on a distal end side of the base member 1. The protruding portion 13 protrudes downward from a base portion 14 of the base member 1 on the mounting surface 15 side. That is, the sectional shape of the protruding portion 13 illustrated in FIG. 2 is continuously arranged along a closed line in which a starting point and an end point are connected to each other, and a portion surrounded by the protruding portion 13 forms the recessed portion 12. The ridge line 11, which is an apex of the protruding portion 13, is formed to have a round shape. A curvature of the ridge line 11 is suitably changed corresponding to a curved surface 31 of the printing member 30. The ridge line 11 is not limited only to the round shape having a predetermined curvature, and may have a shape obtained by combining flat surfaces at the ridge line 11 or a shape obtained by combining a flat surface and a curved surface at the ridge line 11.

Corner portions 16 of the base member 1 having a substantially rectangular shape when the base member 1 is viewed in the direction from the lower side are each formed to have a round shape. The roundness of each of the corner portions 16 is also suitably changed corresponding to the curved surface 31 of the printing member 30.

FIG. 2(*a*) to FIG. 2(*d*) are views for illustrating printing using the printing blanket 10. FIG. 2(*a*) is a view for illustrating a state before the printing blanket 10 is pressed against the printing original plate 20. The ink 40 is arranged on the printing original plate 20. The ink 40 is arranged so that a plurality of ink drops are designed to form a predetermined printing image. The ink 40 is arranged on the printing original plate 20 by, for example, intaglio printing, relief printing, or inkjet printing.

The printing blanket 10 is pressed against the printing original plate 20 from the ridge line 11 to be deformed, and a predetermined region mainly of the ridge line 11 is pressed against a surface of the printing original plate 20. The predetermined region is referred to as the printing surface 18. The ink 40 arranged on the printing original plate 20 adheres to be transferred to the printing surface 18 of the printing blanket 10. The base member 1 is easily deformed because the base member 1 is made of, for example, a silicon rubber containing a large amount of silicon oil.

Before the printing blanket 10 is pressed against the printing original plate 20, a solvent may be applied to the printing surface 18 to bring the printing surface 18 into a wet state. This treatment allows the ink 40 to be easily transferred to the printing surface 18.

As illustrated in FIG. 2(*b*), after the ink 40 is transferred to the printing surface 18, the printing surface 18 is pressed against the printing member 30. Consequently, the ink 40 transferred to the printing surface 18 is transferred from the printing surface 18 to the printing member 30, with the result that a printing image is transferred to the printing member 30. The printing blanket 10 is formed to be deformed easily. Consequently, the printing blanket 10 easily follows a surface to be printed having a curved surface shape and has satisfactory compatibility with such surface.

<State of Printing Surface 18 During Printing>

FIG. 2(*c*) is a view for illustrating a cross section in a state in which the printing blanket 10 according to Embodiment 1 of the present invention is pressed against the printing member 30. The printing member 30 is, for example, a cover member having a curved surface to be adopted in a display portion of a touch panel in a smartphone or other devices. The cover member is made of, for example, a material such as glass and polycarbonate. The printing member 30 has a shape in which an edge of a rectangular flat plate in plan view is bent upward to form the curved surface 31 as illustrated in FIG. 2(*c*). A surface of the printing member 30 on which printing is performed has a dish-like shape recessed at the center. In a state in which the printing surface 18 of the printing blanket 10 is pressed against the printing member 30, the protruding portion 13 is deformed to follow the curved surface 31, and the printing surface 18 is brought into contact with the curved surface 31. Thus, the ink 40 adhering to the printing surface 18 is transferred to the curved surface 31 of the printing member 30 as illustrated in FIG. 2(*d*).

As illustrated in FIG. 2(*b*) and FIG. 2(*c*), it is desired that the ink 40 not be arranged on the apex of the protruding portion 13, that is, on the ridge line 11. When the ink 40 is arranged on the ridge line 11 and the printing blanket 10 is pressed against the printing original plate 20 or the printing member 30, air bubbles may be caught between the ink 40 and the printing surface 18, or between the ink 40 and the printing member 30. Consequently, the ink 40 is arranged on a surface on an outer side from the ridge line 11 on a surface of the base member 1.

Further, as illustrated in FIG. 2(*c*), a pressing force 50 from the printing device is applied to the printing blanket 10 from the mounting surface 15 side. The pressing force 50 is transmitted to the printing member 30 through the base member 1. The base member 1 formed of an elastic body that is easily deformed is deformed by the pressing force 50 along the shape of the printing member 30. In this case, a portion of the base member 1 that faces a region on which printing is not performed corresponds to the recessed portion 12, and the recessed portion 12 is not brought into contact with the printing member 30. With this operation, the pressing force 50 is applied to only a region including the printing surface 18 and brought into contact with the printing member 30, and is applied in a uniformly distributed manner as represented by the arrows 51 illustrated in FIG. 2(*c*). As a result, the pressing force 50 can efficiently be applied to the printing surface 18, and hence as compared to the case where the recessed portion 12 is not arranged, the contact between the printing surface 18 and the curved surface 31 of the printing member 30 is satisfactory, resulting in good-quality printing.

In Embodiment 1, as illustrated in FIG. 1, the printing blanket 10 has a substantially rectangular shape when the printing blanket 10 is viewed from the printing surface 18 side. However, the shape of the printing blanket 10 may be suitably changed corresponding to the shape of the printing member 30. The printing blanket 10 may be formed into, for example, a circular shape when the ridge line 11 is viewed from the printing surface 18 side.

Figure 3:
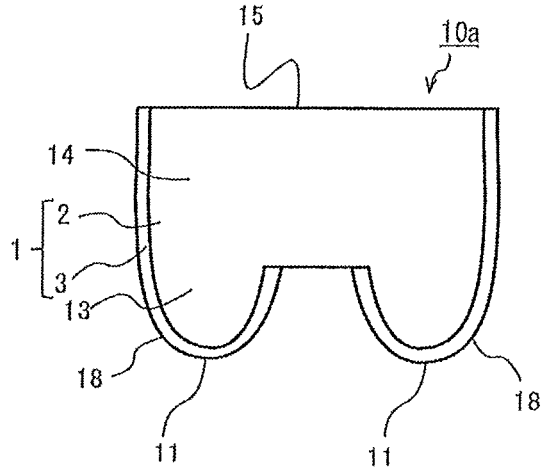
FIG. 3 is a view for illustrating a cross section of the printing blanket of a modification example of Embodiment 1 of the present invention.

FIG. 3 is a view for illustrating a cross section of a printing blanket 10*a* of a modification example of Embodiment 1 of the present invention. The printing blanket 10*a* is different from the printing blanket 10 in that the base member 1 includes two portions of an inner layer 2 and an outer coating layer 3. That is, the base member 1 is formed in such a manner that the outer coating layer 3 is bonded to a surface of the inner layer 2. The printing surface 18 lies on a surface of the outer coating layer 3. The outer coating layer 3 including the printing surface 18 is bonded to an outer surface of the inner layer 2 to ensure durability of the printing blanket 10 and reduce ooze of silicon oil from the inner layer 2. Consequently, although the outer coating layer 3 is made of a material having higher hardness than that of the inner layer 2, the outer coating layer 3 easily follows the deformation of the inner layer 2 because of its small thickness. That is, even when the printing surface 18 is pressed against the printing member 30 including the curved surface 31 illustrated in FIG. 2, the printing surface 18 follows the curved surface 31. Further, the inner layer 2 and the outer coating layer 3 may be further formed of a plurality of layers.

Figure 4:
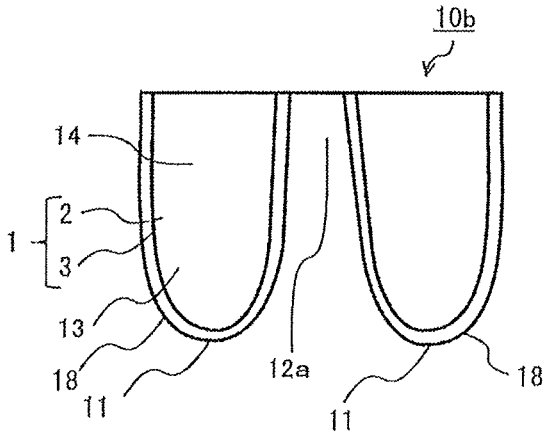
FIG. 4 is a view for illustrating a cross section of the printing blanket of another modification example of Embodiment 1 of the present invention.

FIG. 4 is a view for illustrating a cross section of a printing blanket 10*b* of a modification example of Embodiment 1 of the present invention. The inner layer 2 may have a hole portion 12*a* instead of the recessed portion 12. That is, the inner layer 2 may be formed by surrounding the hole portion 12*a* with a three-dimensional shape including the ridge line 11. In FIG. 4, the printing blanket 10*b* includes the outer coating layer 3. However, the printing blanket 10*b* may be formed of only the inner layer 2.

Figure 5:
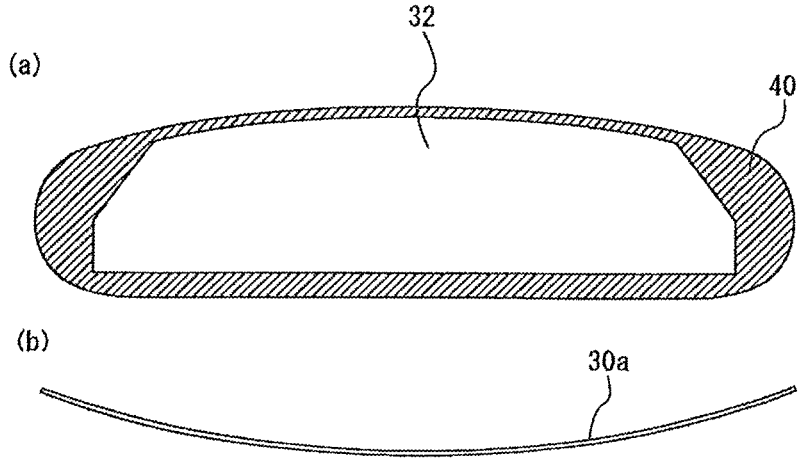
FIG. 5 are each a view for illustrating an example of a printing member subjected to printing with the printing blanket according to Embodiment 1 of the present invention.

FIG. 5 are each a view for illustrating an example of a printing member 30*a* subjected to printing with the printing blanket 10 according to Embodiment 1 of the present invention. FIG. 5(*a*) is a front view of the printing member 30*a*. FIG. 5(*b*) is a bottom view of FIG. 5(*a*), for illustrating the shape of the curved surface 31 of the printing member 30*a* on which printing is performed. The printing member 30*a* is, for example, an interior component of an automobile. The printing surface 18 of the printing blanket 10 is pressed against a portion of the printing member 30*a* that is illustrated with the hatched lines in FIG. 5(*a*), and the ink 40 is printed on the portion. A center of the printing member 30*a* is a display portion 32. The display portion 32 does not have the ink 40 adhering to the display portion 32 and enables the surface of the printing member 30*a* to be visually recognized. The display portion 32 is generally transparent and enables the other side of the printing member 30*a* to be visually recognized. In the printing blanket 10 according to Embodiment 1 formed into a three-dimensional shape with a recess or a hole in a center, printing can be performed on a flat surface having a curved surface in an edge portion of the flat surface such as the printing member 30*a*.

Effects of Embodiment (1) The printing blanket 10 according to Embodiment 1 includes the base member 1 made of an elastic material having a three-dimensional shape with the recessed portion 12 or the hole portion 12*a* in the center of the base member 1 and the ridge line 11 surrounding the recessed portion 12 or the hole portion 12*a*, and the printing surface 18 arranged on the surface of the base member 1 on the outer side from the ridge line 11.

With the above-mentioned configuration, the printing blanket 10 can be uniformly brought into contact with a curved surface portion of the printing member 30, for example, a cover member having a curved surface to be adopted in a touch panel of a smartphone or other devices, and hence good-quality printing can be performed on a curved surface.

(2) In the printing blanket 10 according to Embodiment 1, the base member 1 includes the inner layer 2 and the outer coating layer 3. The outer coating layer 3 may have a sheet shape, may be bonded to the surface of the inner layer 2, and may be made of a material having hardness equal to or more than hardness of the inner layer 2.

With the above-mentioned configuration, a sheet-shaped rubber having hardness higher than that of the inner layer 2 is used for the printing surface 18, and hence the durability of the printing surface 18 of the printing blanket 10 can be ensured. Further, when a scratch or dirt is caused on the printing surface 18, the printing surface 18 can be removed and replaced by another sheet-shaped rubber. Further, the inner layer 2 is made of, for example, a soft silicon rubber containing silicon oil, and the ooze of the silicon oil from the inner layer 2 can be reduced by arranging the outer coating layer 3. Thus, the printing blanket 10 can reduce the contamination of the printing original plate 20 and the printing member 30 with silicon oil.

(3) In the printing blanket 10 according to Embodiment 1, the inner layer 2 may include a plurality of laminated layers.

With the above-mentioned configuration, the dimensions of the inner layer 2 can be changed corresponding to the shape of the printing member 30. Further, when the inner layer 2 is damaged, the inner layer 2 can also be removed and replaced.

(4) In the printing blanket 10 according to Embodiment 1, it is preferred that the outer coating layer 3 have a thickness of 0.1 mm or more and 1.0 mm or less.

With the above-mentioned configuration, the outer coating layer 3 does not inhibit the deformation of the inner layer 2, and hence the printing blanket 10 can be deformed to follow the printing member 30. Moreover, the printing blanket 10 can exhibit the effect of the above-mentioned section (2). However, the thickness of the outer coating layer 3 is not limited only to the above-mentioned thickness as long as the outer coating layer 3 does not inhibit the deformation of the inner layer 2 and can be deformed to follow the printing member 30.

(5) In the printing blanket 10 according to Embodiment 1, the inner layer 2 may be made of a silicon rubber containing silicon oil.

With the above-mentioned configuration, the printing blanket 10 can be formed to be easily deformed and easily follow the shape of the printing member 30, and the effect described in the above-mentioned section (1) can be reliably exhibited.

(6) A printing method using the printing blanket 10 according to Embodiment 1 includes an original plate pressing step of pressing, against the printing original plate 20 having the ink 40 arranged on the printing original plate 20, the printing surface 18 arranged on the surface of the base member 1 made of an elastic material having a three-dimensional shape with the recessed portion 12 or the hole portion 12*a* in the center of the base member 1 and the ridge line 11 surrounding the recessed portion 12 or the hole portion 12*a*, the surface of the base member 1 being on the outer side from the ridge line 11, and an ink transferring step of transferring the ink 40 to the curved surface portion of the printing member 30 having a flat surface and a curved surface in an edge portion of the flat surface by pressing the printing surface 18 against the curved surface portion.

With the above-mentioned configuration, printing can be performed with good quality on the printing member 30 such as a cover member for a display portion of, for example, a touch panel having the curved surface 31. Further, the printing blanket 10 is also excellent in durability, and hence it is possible to perform printing suitable for mass production of a cover member for a display portion of, for example, a touch panel.

REFERENCE SIGNS LIST

1 base member 2 inner layer 3 outer coating layer 10 printing blanket 10*a* printing blanket 11 ridge line 12 recessed portion 13 protruding portion 14 base portion 15 mounting surface 16 corner portion 18 printing surface 20 printing original plate 30 printing member 30*a* printing member 31 curved surface 32 display portion 40 ink 50 pressing force 51 arrow

The invention claimed is:

1. A printing blanket, comprising:

a base member made of an elastic material having a three-dimensional shape with a recessed portion in a center of the base member, the base member comprising a mounting surface, a base portion extending below the mounting surface and a protruding portion protruding from the base portion on opposed sides of the recessed portion, the protruding portion being of ovate shape and comprising an inner surface, an outer surface and a ridge line between the inner surface and the outer surface, the inner surface of the protruding portion extending from the ridge line to a surface of the recessed portion, the surface of the recessed portion being disposed between the mounting surface and the ridge line, the outer surface of the protruding portion extending from the ridge line to the mounting surface; and the outer surface of the protruding portion comprising a printing surface configured such that, when the ridge line of the protruding portion is pressed against a curved surface of a printing member, ink from the printing surface is transferable to the curved surface, the base member comprising an inner layer and an outer coating layer, the outer coating layer having a sheet shape, being bonded to a surface of the inner layer, and being made of a material having a hardness equal to or more than a hardness of the inner layer.

2. The printing blanket of claim 1, wherein the inner layer comprises a plurality of laminated layers.

3. The printing blanket of claim 1, wherein the outer coating layer has a thickness of 0.1 mm or more and 1.0 mm or less.

4. The printing blanket of claim 1, wherein the inner layer is made of a silicon rubber containing silicon oil.

5. A printing method comprising:

(a) providing the printing blanket of claim 1;

(b) pressing the printing blanket against a printing original plate having an ink arranged on the printing original plate such that the ink is selectively transferred to the outer surface of the printing surface only; and (c) transferring the ink from the printing surface to a curved surface portion of a printing member having a flat surface and curved surface in an edge portion of the flat surface by pressing the printing surface against the curved surface portion.

6. A printing method, comprising:

pressing a printing surface of a printing blanket against a printing original plate, the printing surface being arranged on a surface of a base member made of an elastic material having a three-dimensional shape with a recessed portion or a hole portion in a center of the base member and a ridge line surrounding the recessed portion or the hole portion, the printing surface of the base member being on an outer surface from the ridge line, the base member also comprising an inner surface on an opposite side of the ridge line, the ink being arranged on the printing original plate such that the pressing transfers ink from the printing original plate to the outer surface of the base member only; and transferring the ink selectively to a curved surface portion of a printing member having a flat surface and a curved surface in an edge portion of the flat surface by pressing the printing surface and the ridge line against the curved surface portion.

7. A printing blanket, comprising:

a base member made of an elastic material having a three-dimensional shape with a hole portion in a center of the base member, the base member comprising a mounting surface, a base portion extending below the mounting surface and a protruding portion protruding from the base portion on opposed sides of the hole portion, the protruding portion being of ovate shape and comprising an inner surface, an outer surface and a ridge line between the inner surface and the outer surface, the inner surface of the protruding portion extending from the ridge line to the mounting surface; and the outer surface of the protruding portion comprising a printing surface configured such that, when the ridge line of the printing surface is pressed against a curved surface of a printing member, ink from the printing surface is transferable to the curved surface, the base member comprising an inner layer and an outer coating layer, the outer coating layer having a sheet shape, being bonded to a surface of the inner layer, and being made of a material having a hardness equal to or more than a hardness of the inner layer.

8. A printing method comprising:

(a) providing the printing blanket of claim 7;

(b) pressing the printing blanket against a printing original plate having an ink arranged on the printing original plate such that the ink is selectively transferred to the to the outer surface of the printing surface only; and (c) transferring the ink from the printing surface to a curved surface portion of a printing member having a flat surface and a curved surface in an edge portion of the flat surface by pressing the printing surface and ridge line against the curved surface portion.

* * * * *